US005390478A

United States Patent [19]

Holsworth

[11] Patent Number: 5,390,478

[45] Date of Patent: Feb. 21, 1995

[54] ORNAMENTAL SAFETY ACCESSORY FOR STIRRUPS

[76] Inventor: Herbert Holsworth, 212 Summit Ridge Dr., White Lake, Mich. 48386

[21] Appl. No.: 131,885

[22] Filed: Oct. 5, 1993

Related U.S. Application Data

[63] Continuation-in-part of Ser. No. 61,235, May 17, 1993, abandoned.

[51] Int. Cl.[6] ..... B68C 3/00
[52] U.S. Cl. ..... 54/49
[58] Field of Search ..... 54/47, 49

[56] References Cited

U.S. PATENT DOCUMENTS

| | | | |
|---|---|---|---|
| 30,369 | 10/1860 | Williamson | 54/49 |
| 250,466 | 12/1881 | Waehlte | 54/49 |
| 374,021 | 11/1887 | Walker | 54/49 |
| 847,896 | 3/1907 | Breitenstein | 54/49 |

*Primary Examiner*—Robert P. Swiatek
*Attorney, Agent, or Firm*—John R. Benefiel

[57] ABSTRACT

An ornamental safety accessory for riding stirrups is provided by a series of rods fixed to the stirrup by mounting elements attached to the inside of the stirrup opening, the rods forming an inverted U-shape aligned with the stirrup opening. Revolvable elements are distributed along the length of each rod, engaged by the rider's boot when his foot is twisted upwardly or to either side to insure release of the boot even if the rider is thrown.

12 Claims, 3 Drawing Sheets

ORNAMENTAL SAFETY ACCESSORY FOR STIRRUPS

CROSS REFERENCE TO RELATED APPLICATION

This is a continuation-in-part of U.S. Ser. No. 08/061,235, filed on May 17, 1993, and now abandoned.

BACKGROUND OF THE INVENTION

The present invention concerns stirrups for riding saddles and more particularly safety accessories for stirrups. There have heretofore been described safety stirrups having balls or rollers mounted to the top and side of the stirrup opening. The rollers serve to allow a rider's boot to be released when the rider is thrown rather than being trapped by friction which sometimes occurs by twisting of the rider's boot in the stirrup, resulting in a thrown rider being dragged by the horse.

Such a design is shown in U.S. Pat. No. 847,896 issued on Mar. 19, 1907, in which balls or rollers are rotatably mounted on the metal frame forming the stirrup at the sides and the top of the stirrup opening which serve to release the rider's boot by reducing friction.

U.S. Pat. No. 250,466 issued on Dec. 6, 1881, describes a similar design, in which the rollers are mounted on a cross pin at the top of the stirrup opening.

Such designs, while functionally able to achieve the safety function sought, produces a stirrup of unusual appearance, incompatible with the American leather wrapped stirrup style.

Given the recreational and show nature of most present day riding, the odd appearance is a substantial drawback, inhibiting the use of such specially configured stirrups.

As noted, the American style stirrup is comprised of leather covered frames matching the riding saddle and other harness components. Such safety stirrup design cannot be implemented with this style stirrup.

It would be advantageous if such safety stirrup design could be implemented without substantially compromising the appearance of American style leather wrapped stirrups.

Another disadvantage of the safety stirrups heretofore conceived is that the normal frictional contact between the boot and the stirrup is changed by the presence of the rollers or balls surrounding the stirrup opening into which the toe of the rider's boot is inserted.

Accordingly, it is an object of the present invention to provide a safety stirrup of the type preventing frictional locking of a rider's boot when the rider is ornamental and also thrown which is compatible with American style stirrups.

It is a further object of the present invention to provide a safety stirrup in which the normal contact between the rider's boot and the stirrup inside surface is normally maintained despite the presence of the roller safety release feature.

SUMMARY OF THE INVENTION

These and other objects of the present invention are achieved by an arrangement in which a safety accessory is provided which is mounted to a conventional stirrup in such a way as to create a roller safety releasing feature.

This accessory comprises an array of mounting rods forming an inverted U-shape located just forward of the stirrup opening. The rods are supported by four elongated supporting elements, each having a portion extending rearwardly within the stirrup opening, with the ends of the rods supported by forwarding protruding portions of the mounting elements. The support elements may be attached to the stirrup body in various ways including screw fasteners or by cinch tie fastener each encircling the stirrup perimeter and a mounting element.

A series of revolvable elements are distributed along the length of each rod, located just forwardly of the stirrup opening so that the toe of the rider's boot will be inclined into engagement with the revolvable elements upon being twisted up or to either side, to ensure that the rider's boot will not be frictionally trapped and instead be released. This reliably prevents the rider from being dragged after being thrown.

The revolvable elements may be comprised of small machined aluminum cylinders or by colored decorative beads such as to enhance the appearance of the accessory and achieve an ornamental effect for the stirrup.

The elongated mounting elements may alternatively comprise two parts, each of which having an end hooked over the outside edge of the stirrup body, and adapted to be drawn together to be clamped thereto. In one version, an enclosing housing for the two parts can be included to present a smooth interior surface.

An auxiliary rod with revolvable elements may also be mounted at a lower height to adapt the accessory to a smaller boot size.

The accessory may also be adapted to the so-called English style metal frame stirrup in which case a single transverse revolvable element mounting rod may be employed extending across the top of the stirrup opening. The revolvable element mounting rod is clamped to the stirrup by a pair of clamps each received over the stirrup frame.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
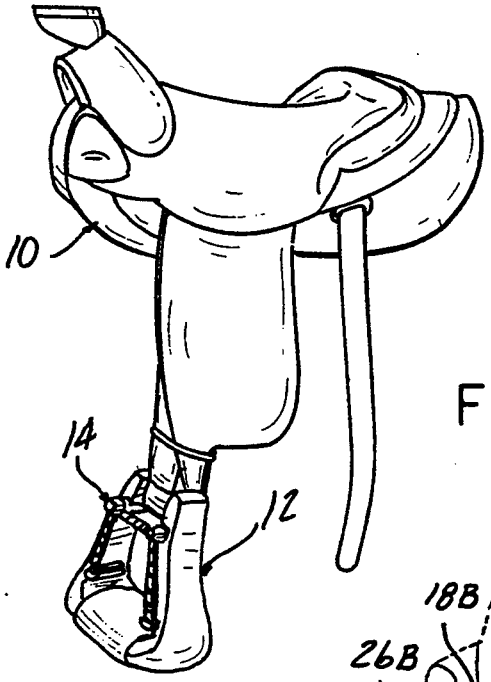
FIG. 1 is perspective view of a saddle showing the stirrup ornamental safety accessory according to the present invention installed thereon.

Referring to the drawings, FIG. 1 shows an American style riding saddle 10 having a leather wrapped stirrup 12 having the ornamental safety stirrup accessory 14 according to the present invention installed thereon.

Figure 2:
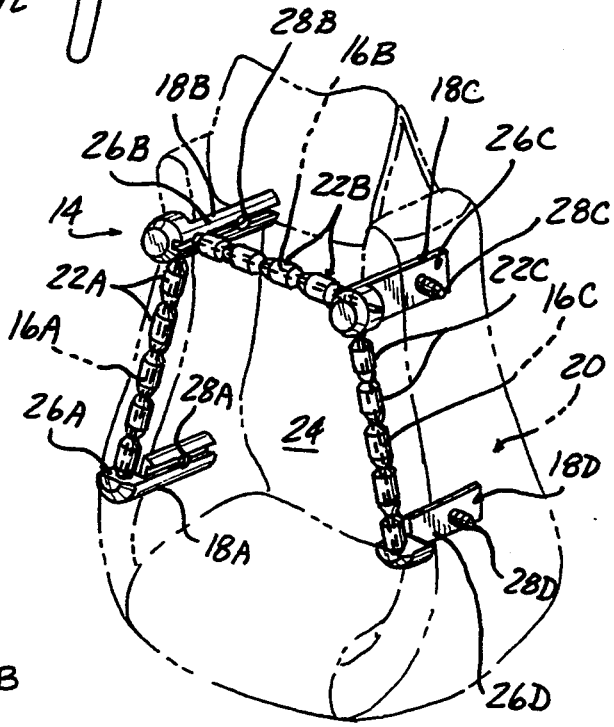
FIG. 2 is an enlarged perspective view of the stirrup shown in FIG. 1 shown in phantom with the accessory according to the invention shown in solid lines.

As better seen in FIG. 2, the stirrup accessory 14 is comprised of an array of three rods 16A, 16B, 16C arranged just forwardly of the stirrup opening in an inverted U-shape pattern. The rods 16A, 16B, 16C are mounted at each end on four elongated mounting elements 18A, 18B, 18C, and 18D affixed to the stirrup body 20, element pairs 18A, 18B, 18C, and 18D are approximately vertically aligned and pairs 18A, 18D and 18B, 18C horizontally aligned. A series of revolvable elements 22A, 22B, and 22C are distributed along the length of each rod 16A, 16B, 16C and rotatably received thereon.

Figure 3A:
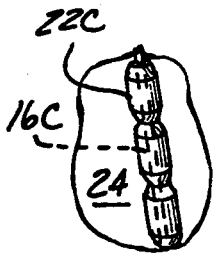
FIG. 3A is a fragmentary front view of a portion of the accessory shown in FIG. 3.

As noted, the three rods 16A, 16B, and 16C form an inverted U-shape located just forward of the front of the stirrup body 20, the sets of revolvable elements 22A, 22B, and 22C only partially protruding within the stirrup opening 24. This location is accomplished by suitable relieving of the mounting elements 18B, and 18C near the top of the opening 24 at 26A and 26C, with the mounting elements 18A and 18D near the bottom of the stirrup opening 24 relieved on two sides at 26A and 26D. This locates the center line of the second and third rods 16A and 16C to be approximately aligned with the inside edge defining the stirrup opening 24 (See FIG. 3A).

Each of the mounting elements 18A, 18B, 18C and 18D extend rearwardly on the inside surface defining the stirrup opening 24 and have preferably smooth, rounded contours such as to not cause scraping of the rider's boot thereagainst.

Each of the mounting elements 18A, 18B, 18C, and 18D includes a portion protruding just forward of the stirrup opening 24, each portion threadably receiving respective end of the rods 16A, 16B, 16C.

The mounting elements 18A, 18B, 18C, and 18D may be mounted to the stirrup body 20 by means of a central screw fastener 28A, 28B, 28C, or 28D as shown in FIG. 2 received in the stirrup body inside surface defining the stirrup opening 24.

Figure 3:
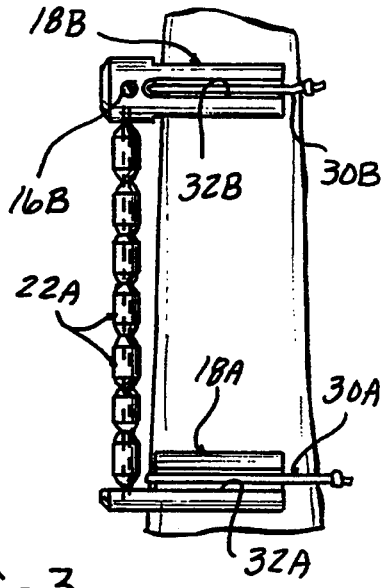
FIG. 3 is a side elevational view of the accessory shown in FIG. 2, with an alternate arrangement for detachably connecting the accessory to the stirrup body, which is also shown in fragmentary form.
Figure 4:
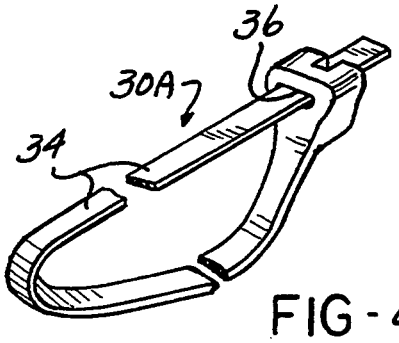
FIG. 4 is an enlarged perspective fragmentary view of one of a plurality of a cinch tie fasteners used to attach the accessory in the embodiment of FIG. 3.

Preferably however, the mounting elements 18A and 18B as shown in FIG. 3 are mounted such as to not mar the leather wrapping of the stirrup 12. Such mounting in this case may be constituted by a plastic cinch tie fastener two of which 30A, 30B shown in FIG. 3 received in a slot 32A or 32B machined into each mounting element 18A, 18B and encircling the stirrup frame. The cinch tie fasteners 30A, 30B elements 30A, 30B may be of a well known commercially available type which comprise a flexible plastic strap 34 received in an opening 36 which with a suitable engagement features allowing the strap 34 to be securely retained when drawn therethrough and tightened. The mounting elements 18C and 18D are similarly mounted with tie fasteners 30C, 30D (FIG. 5) when this attachment is used.

The revolvable elements 22A, 22B, and 22C may be comprised of a series of small machined aluminum cylinders distributed along the length of the respective mounting rods 16A, 16B, 16C, and are designed to freely turn on the rods such as to provide a low friction contact surfaces arrayed about the stirrup opening 24, as best seen in FIG. 3.

The linear array of revolvable elements 22A, 22B, 22C is located just forwardly of the front of the stirrup body 20. It has been determined that when the rider's toe is twisted upwardly or to the right or left, as when a rider has been thrown from the horse and is being dragged by one foot, instead of contacting the side or top of the stirrup, the rider's boot will contact the extremely low friction contact surface defined by the revolvable elements 22A, 22B, 22C preventing the boot from being frictionally trapped within the stirrup opening 24, and the rider thereby being dragged by one foot.

At the same time, the stirrup opening 24 is substantially clear, allowing normal contact between the toe of the rider's boot and the stirrup body surfaces. Also, the appearance of the accessory 14 is highly ornamental and not incompatible with the aesthetic appeal of the leather wrapped American style stirrup.

Figure 5:
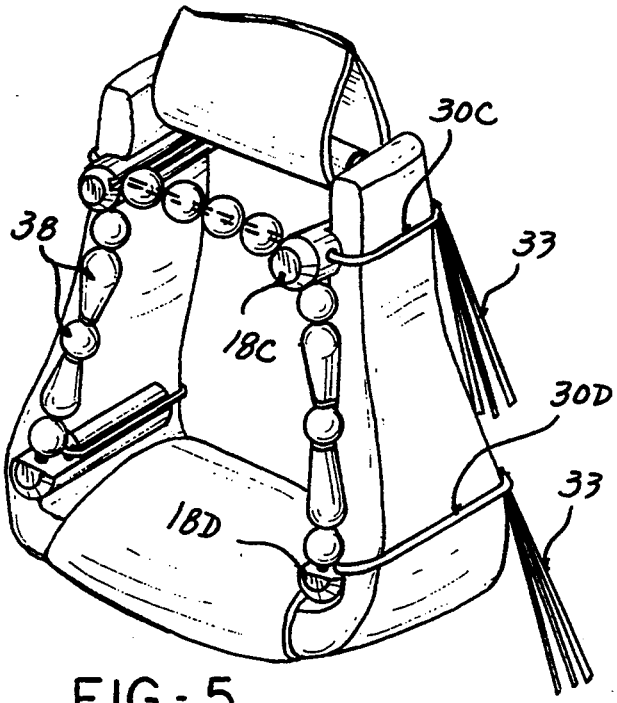
FIG. 5 is a perspective view of a different embodiment of the stirrup accessory according to the present invention showing an ornamental bead form of the revolvable elements.

The ornamental effect may be further enhanced by using colorful and variably shaped beads 38 as shown in FIG. 5, in various pleasing combinations. Streamers 33 are attached to the cinch tie fasteners 30A, 30B, 30C, and 30D to further enhance the decorative effect.

Figure 6:
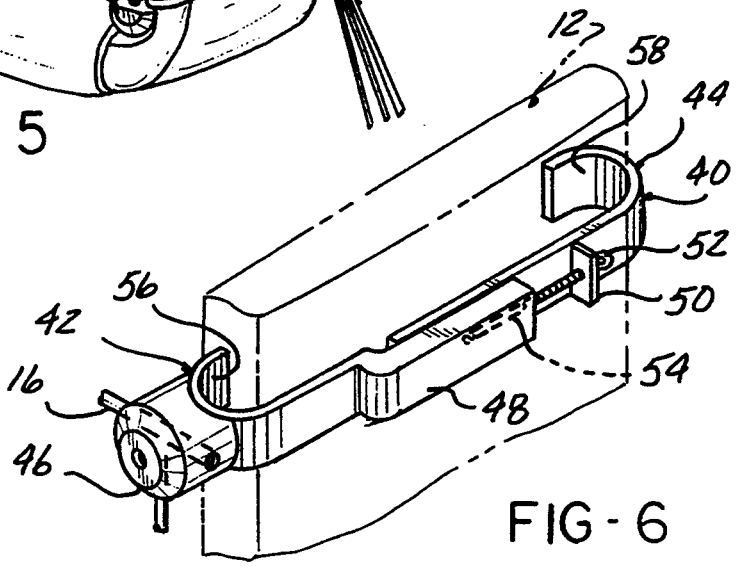
FIG. 6 is a perspective view of an alternate embodiment of the mounting element utilized as a component of the stirrup accessory, in which a screw actuated clamping attachment to the stirrup body is employed, the adjacent portions of the stirrup body shown in phantom.

As an option to the use of the cinch tie fasteners 30A, 30B, 30C and 30D, an alternate clamping arrangement is shown in FIG. 6 in which a part clamping arrangement 40 is provided, comprised of elongated forward part 42 and interfit rearward part 44. The forward section is formed with a rod mounting portion 46 threadably receiving the revolvable element mounting rods 16A, 16B, 16C. The forward part 42 has an offset thicker portion 48 receiving the forward end of the rear section 44. A reaction tab 50 is affixed to the rear section 44 which receives an adjusting clamping screw 52 threadably received in a threaded bore 54 extending lengthwise into the portion 48 of the front part 42. The threaded screw 52 may be advanced to cause the curved hook end portions 56 and 58 of the rear sections of the front and rear parts 42 and 44 to tightly grip the stirrup body portions at the front and rear respectively.

Figure 7:
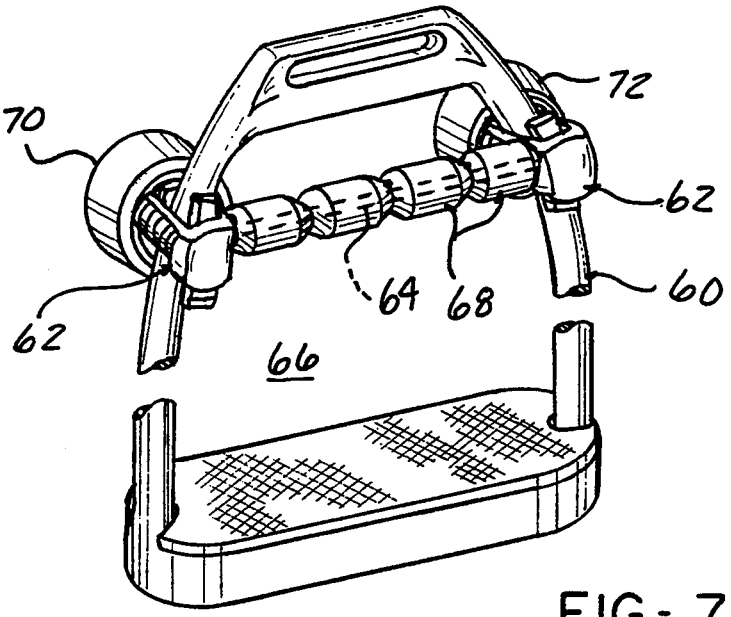
FIG. 7 is a perspective fragmentary view of an English style stirrup shown with yet another alternate embodiment of the stirrup accessory according to the present invention installed thereon.

FIG. 7 shows an adaptation of the accessory to the English style stirrup 60 in which clamping posts 62 are provided mounting a support rod 64 extending across the stirrup opening 66 at the top region thereof; the rod 64 rotatably supports a series of revolvable elements similar to those shown above.

Decorative covering caps 70 of rubber may be fit over the exposed ends of the clamping posts 62.

Figure 8:
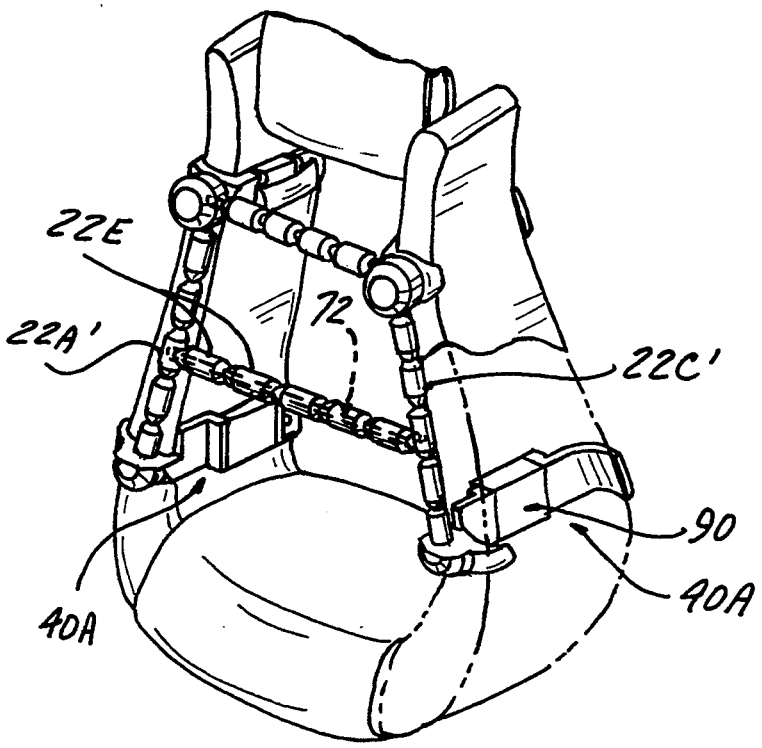
FIG. 8 is a perspective view of another form of the invention, including an auxiliary rod with revolvable elements and an enclosed two part clamping arrangement, a stirrup shown in phantom.

FIG. 8 shows an auxiliary rod 72 threaded at its ends to a revolvable element 22A' and 22C' on either side at an intermediate height. Revolvable elements 22E are mounted on the auxiliary rod 72 such that an array of revolvable elements is disposed at a lower height across the stirrup's opening, to enable the accessory to be fit to a smaller sized boot.

Enclosed two part clamping arrangements 40A are also shown.

Figure 9:
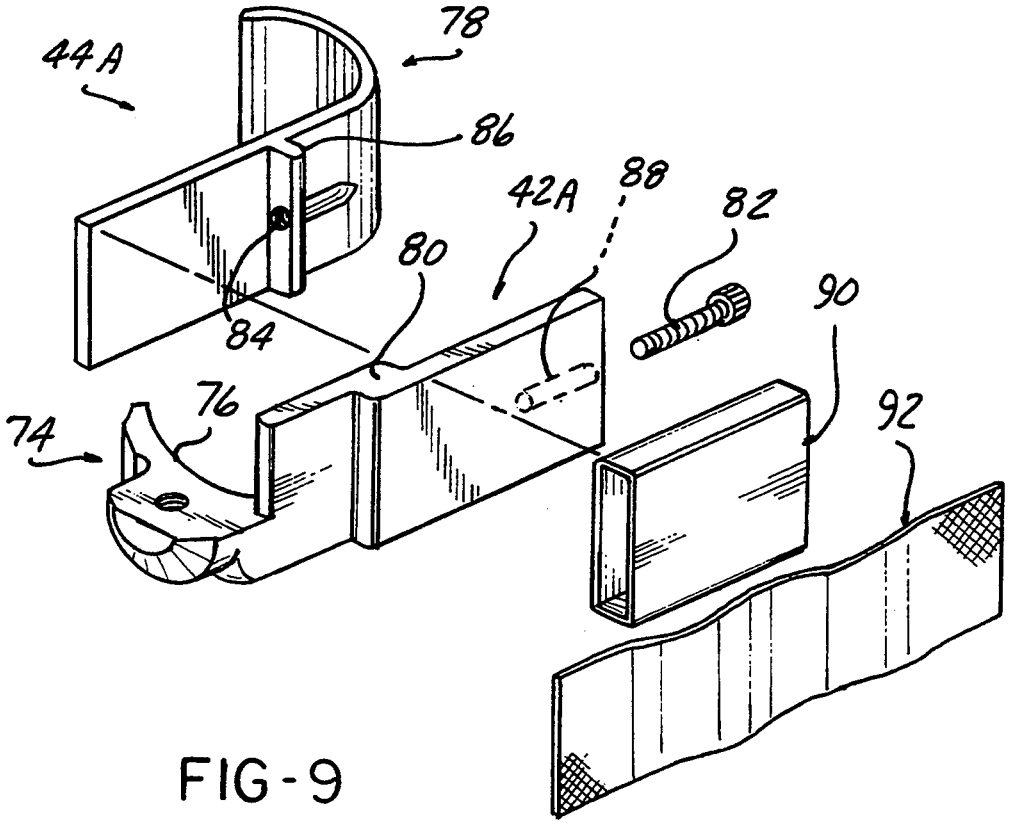
FIG. 9 is an exploded view of the enclosed clamping arrangement shown in FIG. 8.

In this arrangement, shown in FIG. 9, a forward part 42A is provided with a curved formed section 74 having a surface 76 received around the front of the stirrup; rear part 44A having a hooked end 78 is received around the rear of the stirrup.

The rear part 44A is overlapped against an offset 80 of the front part 42A, with a screw 82 passing through a hole 84 on a tab 86 and threadably received in a threaded hole 88 extending into a rear end of the front part 42A to enable tightening onto the stirrup.

An enclosing housing piece 90 is fit over the overlapped sections of the parts 42A, 44A to enclose and hold the clamp parts together and cover the cracks to present a smooth inner surface.

A bright metal finish such as provided by aluminum or chrome is preferably used. Adhesively attached fabric strips 92 applied over the inside surfaces can also be used to present a soft surface to the rider's boot.

Accordingly it can be appreciated that the accessory according to the present invention can be added to existing stirrups and that the basic appearance of the stirrup can be maintained or enhanced. The accessory provides a decorative embellishment to the stirrup and yet functions very effectively to prevent the riding accidents of the sort described by insuring release of the rider's boot in the event the rider is thrown by his mount.

I claim:

1. In combination, a safety accessory and a stirrup of a riding saddle, said stirrup comprised of a stirrup body having top, bottom, and side portions defining an opening adapted to receive the boot of a rider inserted from the rear of said stirrup body, said safety accessory comprising a plurality of elongated mounting elements arrayed about the top and side portions of said stirrup body, each mounting element detachably fixed to a portion of said stirrup body and extending to the front of said stirrup body, each of said mounting elements having an end portion located forwardly of said stirrup body; a plurality of mounting rods, each rod extending between said end portion of two adjacent mounting elements to extend along a side or top portion of said stirrup opening to be spaced forwardly from said stirrup body; at least one revolvable element mounted on each of said mounting rods to be rotatable thereon, whereby a portion of a boot of a rider protruding through said opening to the front of said stirrup body will engage at least one of said revolvable elements upon being twisted in said stirrup opening to reduce the frictional contact force between said boot and said stirrup body under said twisted condition of the rider's boot.

2. The safety accessory according to claim 1 wherein four of said mounting elements are fixed to the side portions of said stirrup body, two aligned across from each other and near the top of said stirrup body opening and two aligned across from each other near the bottom of said stirrup body opening, wherein three mounting rods are included, a first mounting rod extending between said two mounting elements near the top of said stirrup body opening, a second mounting rod extending between one of said mounting elements near the top of said stirrup body opening and the mounting element therebelow and a third mounting rod extending between the other of said mounting elements near the top of said stirrup body opening and the mounting element therebelow, said three mounting rods forming an inverted U-shape forward of said stirrup body opening; and a series of revolvable elements distributed along the length of each of said mounting rods to be independently rotatable thereon, whereby the rider's boot upon being twisted up or to either side in said stirrup body opening will engage revolvable elements on one of said mounting rods to reduce the frictional contact force between said boot and said stirrup body under said twisted condition of the rider's boot.

3. The safety accessory according to claim 2 wherein said protruding portion of each of said mounting elements is offset to lie partially outside said stirrup body and said second and third mounting rods are positioned approximately aligned with the inside of said stirrup body top and side portions, so that said revolvable elements only partially protrude into said stirrup body opening.

4. The safety accessory according to claim 2 wherein at least some of said revolvable elements comprise decorative colored beads.

5. The safety accessory according to claim 2 further including an auxiliary fourth mounting rod extending between said second and third mounting rods and attached at an intermediate level, and revolvable elements mounted on said fourth mounting rod whereby a smaller sized stirrup opening is created.

6. The safety accessory according to claim 1 wherein said revolvable elements comprise machined aluminum cylinders.

7. The safety accessory according to claim 1 wherein said mounting elements are located against the inside of said stirrup body perimeter.

8. The safety accessory according to claim 7 wherein said mounting elements are fastened by at least one screw extending through each of said mounting elements and into said stirrup body perimeter.

9. The safety accessory according to claim 7 wherein each of said mounting elements is slotted along the length thereof and further including a cinch tie fastener encircling each mounting element and adjacent portion of said stirrup body perimeter, whereby each of said mounting elements is secured to said stirrup body within said opening thereof.

10. The safety accessory according to claim 1 wherein said stirrup is of an American leather wrapped style.

11. The safety accessory according to claim 1 wherein each of said mounting elements is comprised of two parts, each part including an end hooked around an opposite outside portion of said stirrup body side portions, and further including clamping means drawing said two parts towards each other to clamp said mounting element to said stirrup body.

12. The safety accessory according to claim 11 further including a housing enclosing said two parts to present a smooth inner surface.

* * * * *